United States Patent [19]

Gooding

[11] 4,375,108

[45] Mar. 1, 1983

[54] ENERGY-ABSORBING INSERT FOR PROTECTIVE HEADGEAR

[75] Inventor: Elwyn R. Gooding, Ann Arbor, Mich.

[73] Assignee: The Regents of the University of Michigan, Ann Arbor, Mich.

[21] Appl. No.: 229,199

[22] Filed: Jan. 28, 1981

[51] Int. Cl.[3] ..... A42B 3/02

[52] U.S. Cl. ..... 2/413

[58] Field of Search ..... 2/413, 414, 411, 416, 2/410

[56] References Cited

U.S. PATENT DOCUMENTS

| | | | |
|---|---|---|---|
| 3,668,704 | 6/1972 | Conroy | 2/413 |
| 4,023,213 | 5/1977 | Rovani | 2/413 |
| 4,038,700 | 8/1977 | Gyory | 2/413 |
| 4,060,855 | 12/1977 | Rappleyea | 2/413 |

FOREIGN PATENT DOCUMENTS

| | | | |
|---|---|---|---|
| 2272617 | 12/1975 | France | 2/413 |

*Primary Examiner*—Peter P. Nerbun

*Attorney, Agent, or Firm*—Olsen and Stephenson

[57] ABSTRACT

An ancillary multichambered fluid-filled cushion for use as an energy-absorbing insert on the inside of protective headgear of the type having an outer helmet shell and a flexible inner liner. The chambers may be distinct or may be interconnected by means of communicating passages which control the flow of fluid between chambers. The chamber and communicating passages are formed of resilient material bonded together at perimeter flanges which may be engageable with the helmet inner liner so as to hold the cushion in place. The cushion is aligned intermediate the wearer's head and the outer shell, between existing inner liner components, so as to provide partial support of the helmet shell.

4 Claims, 9 Drawing Figures

ENERGY-ABSORBING INSERT FOR PROTECTIVE HEADGEAR

BACKGROUND OF THE INVENTION

The present invention relates to protective equipment, and, more particularly, to protective headgear.

In the past, a wide variety of protective headgear has been devised for use by participants in a number of sports, such as football, hockey, and baseball, and for use as crash helmets to protect a wearer's head in the event of a collision. Such headgear has ranged from simple cloth or leather head coverings with minimal padding to hard outer shells supported upon a network of straps. More recently, as developing technology has made possible the more accurate measurement of forces actually transmitted to the wearer's head responsive to a blow directed against the protective headgear, significant improvements have been made with respect to the energy absorbing characteristics of such headgear.

Consistent with the current state of the art, one of the preferred designs of protective headgear features a relatively hard outer helmet shell in conjunction with flexible inner liners having a plurality of elongated fluid-filled members to support the helmet and dissipate forces applied thereto. More specifically, this current design generally utilizes one flexible air-filled inner liner positioned within a second similar inner liner and pad means positioned in openings formed by the elongated fluid-filled liner members. The pad means has been made of relatively firm material, such as a rubber and polyvinyl cloride foam composition, which is crushable upon impact. Laboratory testing has demonstrated that very little lateral dissipation of energy occurs directly behind the impact site upon the helmet shell with the previously used pad means. Further, the previously utilized pad means results in substantial wearer discomfort and must be replaced regularly due to the inability of the pad means to regain its energy absorbing qualities subsequent to repeated deformation.

SUMMARY OF THE INVENTION

The present invention is a multichambered fluid-filled cushion for use as an energy-absorbing insert to be positioned on the inside of protective headgear. The chambers may be distinct or may be interconnected by means of communicating passages of predetermined cross section which control the flow of fluid between chambers. The chambers and communicating passages are formed of resilient material by any of various specified techniques and are assembled by dielectric bonding. The cushion is resiliently deformable in differing amounts responsive to a given force applied against the external surface of the protective headgear.

The multichambered fluid-filled cushion of the present invention is designed to coact with flexible fluid-filled inner liners of protective headgear such as those of helmets produced under U.S. Pat. Nos. 3,462,763; 3,994,020; 3,994,021 and 3,994,022. The new fluid-filled cushion of the invention can readily disperse impact forces laterally to the adjacent fluid-filled inner liners and can also absorb energy from the adjacent fluid-filled inner liners. Unlike the pad means of the prior art, the fluid-filled cushion of the present invention regains its energy-absorbing qualities subsequent to repeated deformation. Further, the fluid-filled cushion of the invention does not inhibit the action of the fluid-filled inner liners as does the previously utilized pad means of such helmets.

A principle feature of the present invention is the improved energy-absorbing capability of protective headgear with respect to blows directed against the protective headgear.

Another feature of the invention is the providing of a soft, comfortable inner surface for use in protective headgear for contacting a wearer's head for improved comfort of the wearer.

Another feature of the invention is the providing of a pad means for protective headgear which is preinflated and resilient so as to permit repeated deformation while remaining maintenance free.

Another feature of the invention is the providing of auxiliary wearer protection in the event of a loss of inflation of a fluid-filled inner liner of protective headgear.

Still another feature of the invention is the providing of a pad means which may be readily positioned within protective headgear and readily replaced.

Further features of the invention will become more fully apparent from the following description of the preferred embodiment of this invention and from the appended claims.

DESCRIPTION OF THE PREFERRED EMBODIMENT

Figure 1:
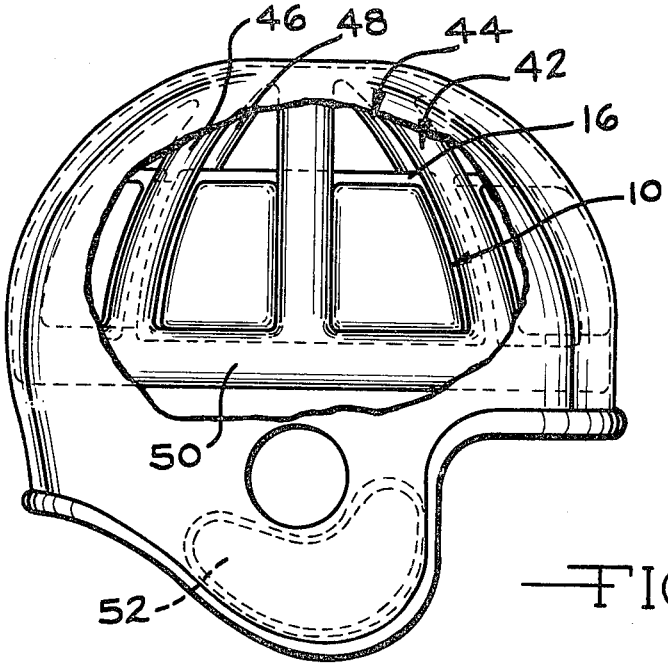
FIG. 1 is a side elevational view of a protective helmet with a portion broken away to show the energy-absorbing inserts of the present invention, with which the helmet is fitted, in assembly relation to the helmet shell and the nesting inner liners of the helmet.
Figure 2:
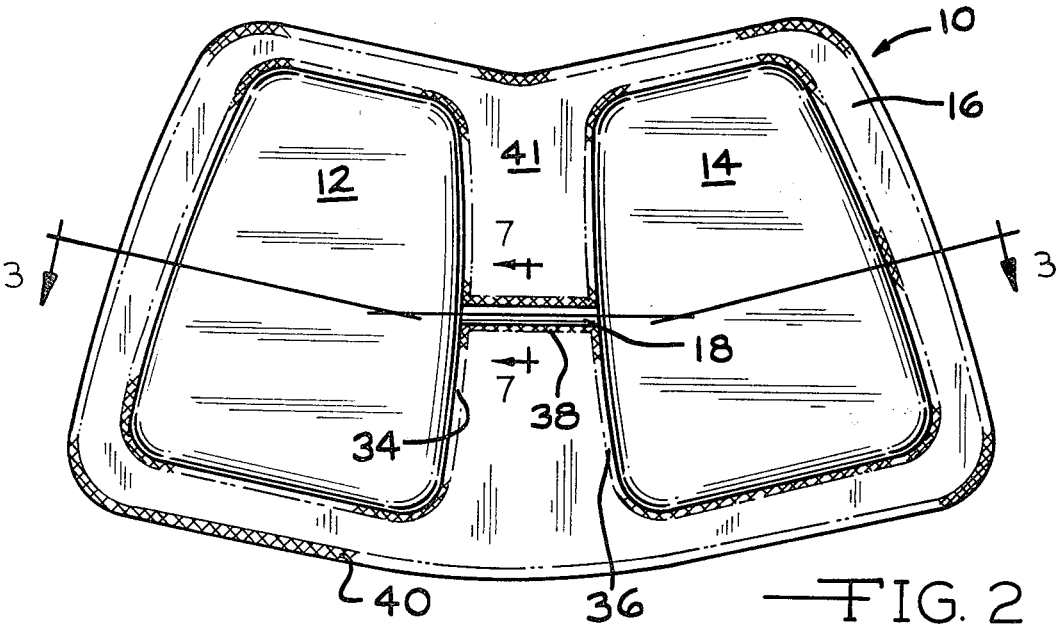
FIG. 2 is a plan view of a multichambered fluid-filled cushion of the present invention.
Figure 3:
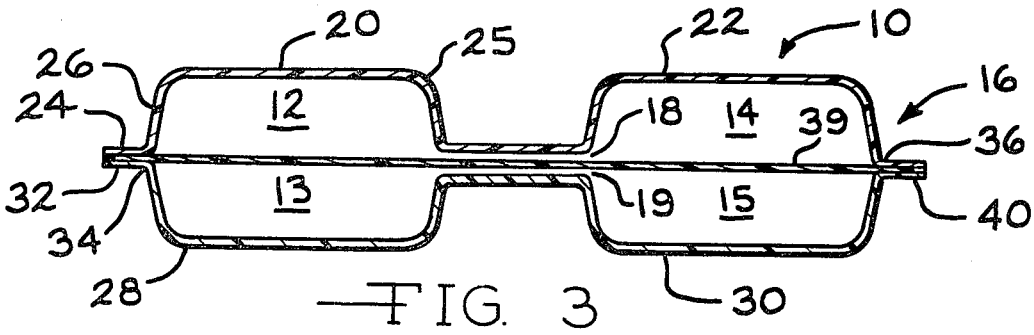
FIG. 3 is a sectional view of the multichambered cushion of FIG. 2 along the line 3—3.
Figure 4:
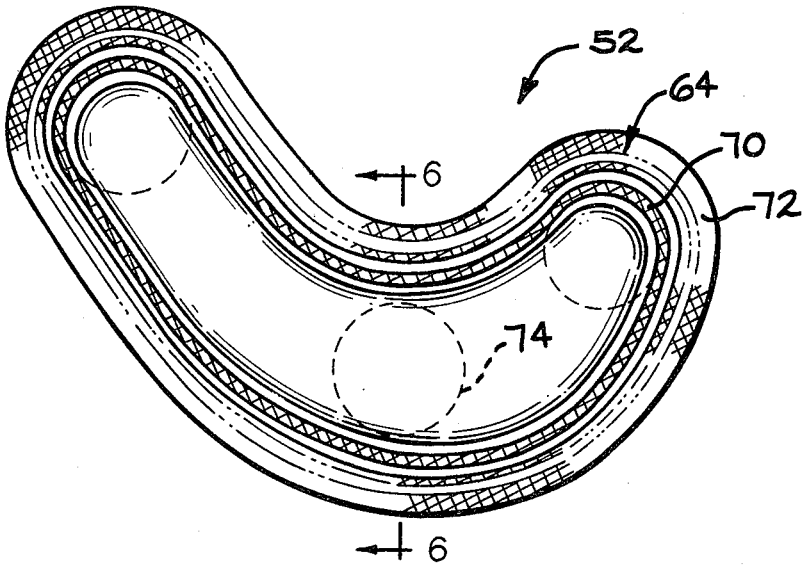
FIG. 4 is a plan view of a second embodiment of the multichambered fluid-filled cushion of the present invention.

With reference to the drawing, one preferred embodiment of the multichambered fluid-filled cushion of the present invention is illustrated in FIGS. 1–4 and 8–9, indicated generally at 10. Four fluid-filled chambers 12, 13, 14, and 15 are joined by a common flange area 16 and are interconnected by fluid carrying passages 18 and 19 as shown in FIG. 3.

In this preferred embodiment, the fluid-filled chambers 12, 13, 14, and 15 are formed from separate mating wall sections which are joined at the flange area 16, as shown in FIGS. 2 and 3. Wall sections 20 and 22 of the fluid-filled chambers 12 and 14 are molded or vacuum formed as pockets extending from a flat flash-like area 24. These pockets are generally trapezoidal in plan view, having radiused corners 25, and have side walls 26, as shown in FIG. 3, converging in a direction extending away from area 24 so as to provide clearance and facilitate forming of the pockets. Similarly shaped wall sections 28 and 30 depend from a flat flash-like area 32 to comprise the pockets of fluid-filled chambers 13 and 15.

The wall sections 20, 22, 28 and 30 are dielectrically bonded together at the perimeters 34 and 36 of the fluid-filled chambers 12, 13, 14, and 15 and at the edges 38 along the fluid-carrying passages 18 and 19 to form a primary seal. These four fluid-filled chambers are preinflated and a flat membrane wall 39 is inserted between the flash-like areas 24 and 32 when the wall sections 20, 22, 28 and 30 are bonded together. A secondary safety seal 40 is formed by dielectric bonding of the flat areas 24 and 32 along the intended perimeter of the flange 16. Once the two wall sections are bonded along the intended perimeter, the flange 16 is trimmed to size by steel rule die cutting of the excess flat areas 24 and 32. For clarity, seal areas are indicated in the drawing by shading.

Figure 8:
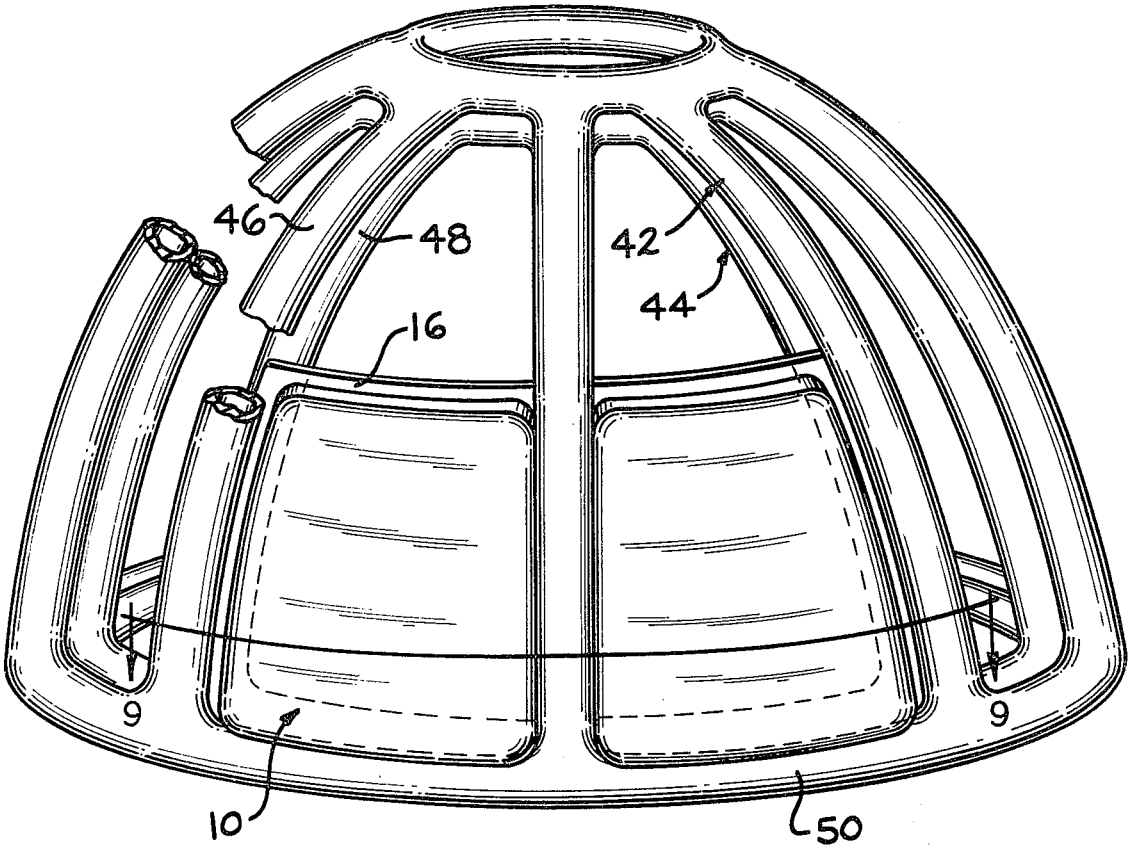
FIG. 8 is a perspective view of the nesting inner liners of the helmet of FIG. 1 showing the positioning of the multichambered fluid-filled cushion of FIG. 2 between elongated members of the inner liners.
Figure 9:
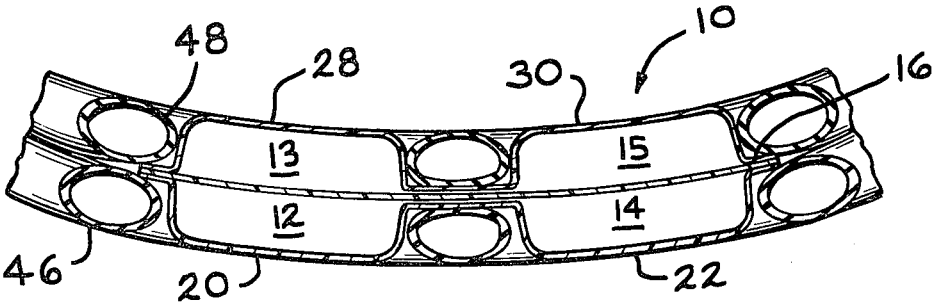
FIG. 9 is a fragmentary sectional view of the nesting inner liners and multichambered fluid-filled cushion of FIG. 8 along the line 9—9.

The flange area 16 extends between the chambers 12 and 14 and between the chambers 13 and 15 to fill the intermediate area 41 and permit the fluid-filled cushion 10 to be held in position between two nesting helmet liners 42 and 44, as shown in FIGS. 1, 8, and 9. The inner liners 42 and 44 include arcuate vertical and horizontal elongated fluid-filled members such as 46, 48, and 50 which define open trapezoidal spaces into which the fluid-filled chambers 12, 13, 14, and 15 are specifically shaped to fit. The configuration of the nesting inner liners 42 and 44, including the pairing of the elongated fluid-filled members, is clearly described in U.S. Pat. Nos. 3,994,020; 3,994,021; and 3,994,022. The projecting flange 16 at the perimeter of the chambers 12, 13, 14 and 15 and the intermediate area 41 are positionable between pairs of the adjacent elongated fluid-filled members so as to hold the cushion 10 in position with respect to the helmet shell.

Figure 5:
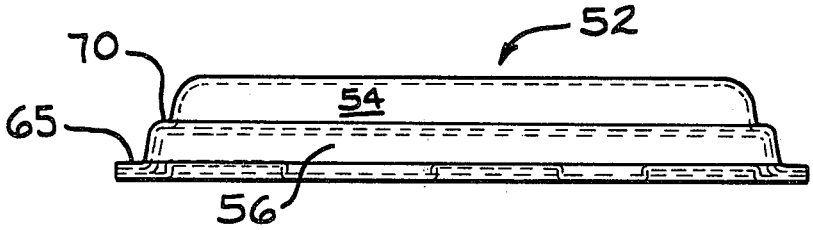
FIG. 5 is a side elevational view of the multi-chambered cushion of FIG. 4.
Figure 6:
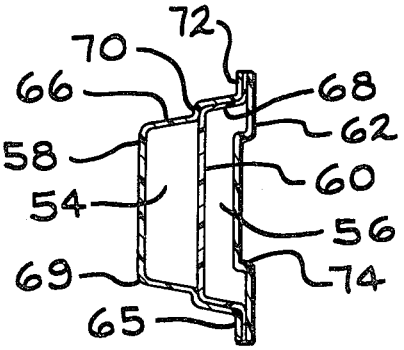
FIG. 6 is a sectional view of the multichambered cushion of FIG. 4 along the line 6—6.
Figure 7:
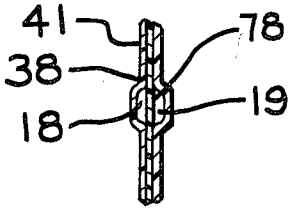
FIG. 7 is a fragmentary sectional view of the multichambered cushion of FIG. 2 along the line 7—7.

With reference to FIGS. 5–7, there is shown a second embodiment of the present invention, generally indicated at 52, which has two fluid-filled chambers 54 and 56 and is particularly designed for use as a mandibular cushion in the type of helmet previously described. The two chambers 54 and 56 are formed by an upper wall 58; a common membrane wall 60, and a bottom wall 62 which are joined at a common flange, generally indicated at 64, by dielectric bonding at 65. The walls 58, 60, and 62 are spaced apart by depending side walls 66 and 68 which are formed integrally with the upper wall 58 and the common membrane wall 60 by molding or vacuum forming. The side walls 66 and 68 converge in a direction extending away from the bottom wall 62 so as to provide clearance and facilitate forming of the pockets. The corners 69 are radiused, and a step 70 is provided between the side walls 66 and 68 to aid fabrication.

The side walls are dielectrically bonded at step 70 so as to form two separate sealed fluid-filled cushion 54 and 56. A safety seal 72, indicated generally by shading, bonds the perimeter of the flange 64, and the cushion 52 is thereafter trimmed to shape and size by steel rule die cutting. Three round recesses 74 are provided for the installation of fasteners such as Velcro tabs or snaps. The cushion 52 is curved into a crescent shape in plan view so as to provide protection for the wearer's mandible while maintaining an open area to clear the wearer's ear. In the embodiment above, two distinct mandibular cushion configurations are used, one adjacent the wearer's right ear and one adjacent the left ear, not shown.

Applicant has found that polyurethane or a blend of vinyl-polyurethane is a preferred material for the energy-absorbing cushion of the present invention. The preferred construction is by dielectric bonding of cushion sections which are air blow molded and preinflated with air. However, roto molding or vacuum forming and alternative bonding means could also be used. Further, liquids or gases other than air could be utilized. Applicant has found that a dielectric seal area 0.040 inch wide is suitable for the primary bonded areas 34, 36, 38, 64, and 70 and that a dielectric seal area 0.100 inch wide is suitable for the safety bonding areas 40 and 72.

The preferred configuration of the energy-absorbing cushion includes a clearance angle of approximately 10 degrees at the side walls 26, 66 and 68 to facilitate molding and increase wearer comfort. It is noted that the preferred embodiments 10 and 52 include fluid-filled chambers formed as Siamesed pairs with a common wall consisting of a membrane 39 or 60 between them. These paired fluid-filled chambers are positioned as two concentric protective layers about the wearer's head. Applicant has found that the bifurcated construction of the cushions 10 and 52 gives additional wearer protection in the event of a rupture of the fluid-filled cushion 10 and that the membrane between the chambers tends to stabilize the cushion shape.

It will be seen from the foregoing description of the preferred embodiment that the present invention provides a soft, comfortable pad means which is preinflated and resilient so as to permit repeated deformation while remaining maintenance free. Further, it can be seen that the present invention provides auxiliary wearer protection in the event of loss of inflation of an inner liner and that the pad means of the present invention may be readily positioned and secured with respect to the inner liners of the helmet. While the preferred embodiments have been described in considerable detail, the present invention is not limited to such detail except as may be necessitated by the appended claims.

What is claimed is:

1. An energy-absorbing cushion for use in protective headgear of the type having an outer helmet shell adapted to be supported over a wearer's head by a flexible inner liner, said cushion comprising a plurality of resilient wall members secured together so as to form a plurality of fluid-filled chambers having walls of resilient material confining the fluid within said chambers, said cushion being mountable on the inside of said helmet shell so as to contact the wearer's head and provide at least partial support for said helmet shell, said fluid-filled chambers being formed in pairs positionable concentrically about the wearer's head with one of said wall members forming a common wall of said resilient material dividing said pairs of chambers, each of said pairs including an inner fluid-filled chamber for contacting the wearer's head and an outer fluid-filled chamber to be positioned adjacent the outer helmet shell, each of said inner and outer fluid chambers being positioned side-by-side with a similar chamber and being in fluid communication therewith through a fluid carrying passage.

2. An energy-absorbing cushion as defined in claim 1 wherein said fluid carrying passages are formed by positioning said common wall in a closely spaced relation with the other ones of said wall members.

3. An energy-absorbing protective cushion as defined in claim 2 wherein said wall members are formed of resilient material bonded together along the perimeters of said wall members with said common wall member between the other ones of said wall members located on opposite sides of said common wall member and being formed with facing sections of concave configuration which form a two-chambered cushion.

4. An energy-absorbing protective cushion as defined in claim 3 wherein said bonding along said perimeter forms an external flange located in substantial alignment with said wall member which divides said inner and outer chambers.

* * * * *